United States Patent [19]

Havel

[11] Patent Number: 4,810,937

[45] **Date of Patent: * Mar. 7, 1989**

[54] MULTICOLOR OPTICAL DEVICE

[76] Inventor: Karel Havel, P.O. Box 66, Station M, Toronto, Ontario, Canada, M6S 4T2

[ * ] Notice: The portion of the term of this patent subsequent to Aug. 11, 2004 has been disclaimed.

[21] Appl. No.: 116,202

[22] Filed: Nov. 3, 1987

Related U.S. Application Data

[63] Continuation-in-part of Ser. No. 856,196, Apr. 28, 1986, abandoned.

[51] Int. Cl.[4] ..... H05B 37/02

[52] U.S. Cl. ..... 315/152; 250/205; 250/209; 250/552; 313/500; 313/510; 315/169.3; 315/154; 315/158; 340/701

[58] Field of Search ..... 250/205, 209, 552; 315/152–158, 169.3; 313/499, 500, 510; 340/701

[56] References Cited

U.S. PATENT DOCUMENTS 4,686,425 8/1987 Havel ..... 315/152

*Primary Examiner*—David K. Moore
*Assistant Examiner*—Mark R. Powell

[57] ABSTRACT

A multicolor optical device having at least three optically stable states includes a plurality of pairs of associated light sensors and light sources for emitting light of respectively different colors when activated. Each light source is divided by an opaque wall into a first light emitting portion and a second light emitting portion. The light signals from the first light emitting portions of all light sources are blended to obtain a composite light signal of a variable color. Separate optical feedbacks are established between the second light emitting portions and light sensors in pairs tending to stabilize the light sources in their conditions to thereby maintain the color of the composite light signal.

2 Claims, 1 Drawing Sheet

MULTICOLOR OPTICAL DEVICE

CROSS-REFERENCE TO RELATED APPLICATIONS

This is a continuation of my copending application Ser. No. 06/856,196 filed Apr. 28, 1986 and entitled Multicolor Optical Device, abandoned.

BACKGROUND OF THE INVENTION

1. Field of the Invention

This invention generally relates to optical devices with stabilizing feedback and more specifically to optical devices having several stable states characterized by respectively different colors.

2. Description of the Prior Art

A seven-segment display employing optical feedback to stabilize monochromatic light sources is disclosed in U.S. Pat. No. 3,911,423 issued Oct. 7, 1975 to Horst Arndt et al.

A multicolor semiconductor lamp comprising a plurality of light emitting diodes for emitting light of respectively different colors is disclosed in U.S. Pat. No. 3,875,456 issued Apr. 1, 1975 to Tsuyoshi Kano et al. The light emitting diodes are closely adjacent and covered by a layer of light scattering material to provide an appearance of a single light source.

An optical device capable of exhibiting more than two stable states characterized by respectively different colors is unknown.

SUMMARY OF THE INVENTION

Accordingly, it is the principal object of this invention to provide a multicolor optical device exhibiting a plurality of stable states characterized by respectively different colors.

When attempting to construct an optical device having a plurality of stable states characterized by respectively different colors, it is necessary to solve the problem of simultaneously blending light signals emitted from a plurality of primary color light sources, to obtain a composite light signal of a variable color, and of optically isolating respective light sources, to provide separate optical stabilizing feedbacks.

The problem was solved in the present invention by the provision of opaque walls for dividing each light source into a first light emitting portion and a second light emitting portion.

In summary, a multicolor optical device of the invention includes a plurality of pairs of associated phototransistors and primary color light emitting diodes. Each light emitting diode is divided by an opaque wall into a first light emitting portion and a second light emitting portion. The light signals emitted from the first light emitting portions of all light emitting diodes are blended to obtain a composite light signal of a variable color. Separate optical feedbacks are established between the second light emitting portions and associated phototransistors in pairs tending to stabilize the color of the composite light signal.

BRIEF DESCRIPTION OF THE DRAWINGS

In the drawings in which are shown several possible embodiments of the invention.

Throughout the drawings, like characters indicate like parts.

DESCRIPTION OF THE PREFERRED EMBODIMENTS

Figure 1:
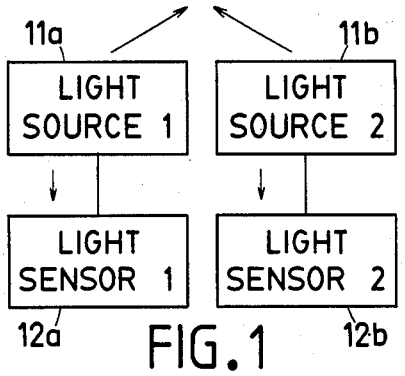
FIG. 1 is a generalized block diagram illustrating the inventive principles of the first embodiment.

Referring now, more particularly, to the drawings, in FIG. 1 is shown, in very general configuration, a multicolor optical device of the present invention which comprises two pairs of serially coupled electro-optical components. The first pair includes a first light source 11*a*, for emitting light of a first primary color, and its associated light sensor 12*a*. The second pair includes a like light source 11*b*, for emitting light of a second primary color, and its associated light sensor 12*b*. The light sensors typically exhibit resistance variable in accordance with illumination. An optical feedback is established in each pair from the light source to the light sensor to exert a toggle effect by varying the resistance of the light sensor in a sense tending to maintain the light source either in its illuminated condition or in its extinguished condition. The light signals emitted by both sources are further combined to form a composite light signal of a color in accordance with the conditions of respective light sources. Consequently, the device has four possible states in accordance with the conditions of respective light sources: emitting light of a first primary color, second primary color, combined primary colors, or being completely extinguished. As will be more specifically revealed subsequently, all these states are optically and electrically stable.

The terms 'light source' and 'light sensor' as used throughout the description of the invention are intended to be interpreted in a broad sense. Light sources may include light emitting diodes, liquid crystal devices, plasma devices, and the like. Light sensors may include phototransistors, photodiodes, photodarlingtons, phototriacs, photo sensitive silicon controlled rectifiers, photodetectors, photoresistors, photoconductive cells, and the like. Optical feedback between the light source and light sensor in each pair may be established either by suitable physical arrangement therebetween or, alternatively, by use of light channeling devices which may include mirrors, prismatic devices, lenses, optical fibers, reflectors, directors, filters, and the like.

Figure 2:
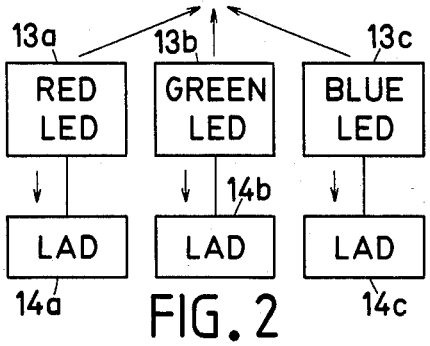
FIG. 2 is a similar generalized block diagram illustrating the inventive principles of the second embodiment.

In FIG. 2 is shown a like optical device having three pairs of electro-optical components. Each pair includes a LED (Light Emitting Diode) 13 and a LAD (Light Activated Device) 14. The three LEDs 13*a*, 13*b*, and 13*c* are respectively adapted for emitting light of three primary colors, red, green, and blue. As will become clearer subsequently, such optical device has a capability to assume one of eight stable optical states in accordance with the conditions of respective light sources: emitting light of red color, green color, blue color, substantially yellow color, substantially purple color, substantially blue-green color, substantially white color, or being completely extinguished.

Figure 3:
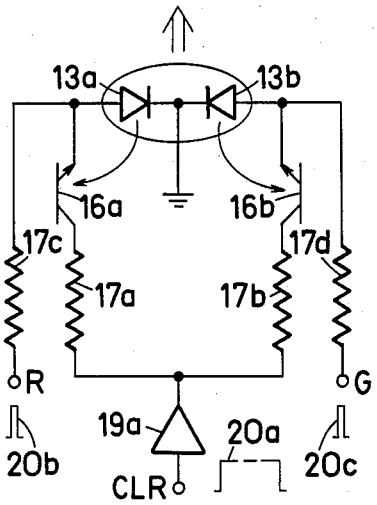
FIG. 3 is a schematic diagram of a two-primary color optical device.

An optical device incorporating the features of the present invention is illustrated in a schematic diagram form in FIG. 3. Two voltage levels, referred to as logic high and low, respectively, are used throughout the description of the circuit. The device employs commercially well known phototransistors which exhibit very high resistance, typically hundreds of Megaohms, when maintained in dark and very low resistance, typically tens of Ohms, when illuminated.

To extinguish the device, a low logic level is momentarily applied to its Clear input CLR. As a consequence, the output of a preferably TTL (Transistor Transistor Logic) buffer 19a also drops to a low logic level. Since a TTL device is not capable of sourcing current from a low logic level output, no current can flow therefrom to ground. Both LEDs 13a, 13b therefore extinguish, and the resistances of the phototransistors 16a, 16b rise to very high values. When a high logic level 20a returns to the input CLR, the output of the buffer 19a also rises to a high logic level. However, the currents flowing via resistor 17a, high resistance of phototransistor 16a and LED 13a to ground, and in parallel, via resistor 17b, high resistance of phototransistor 16b and LED 13b to ground, are very small and not sufficient to illuminate the LEDs. This state is therefore stable and will exist until either of or both inputs R, G are activated.

To illuminate the device in red color, a relatively narrow positive going pulse 20b is applied to its input R (Red). The width of the pulse depends on the response time of the phototransistor and should be sufficient to allow its resistance to drop below a predetermined triggering point. As a consequence, current flows from the input R, via current limiting resistor 17c, which confines the current flow, and LED 13a to ground. The red LED 13a illuminates, and its emission causes the resistance of its associated phototransistor 16a to rapidly drop to a very low value. As a result of positive optical feedback, whereby the increase in luminance of the LED causes the decrease in the resistance of the phototransistor which in turn has an effect of further increase in the luminance and further decrease in the resistance, the current in the red LED 13a branch, from buffer 19a, via resistor 17a and phototransistor 16a, sharply rises to a value sufficient to maintain LED 13a fully illuminated. At the conclusion of the pulse 20b, the magnitude of the LED current is limited substantially by the value of the current limiting resistor 17a. It is readily apparent that this state is stable and will exist until another input of the device is activated.

To illuminate the device in green color, a positive going pulse 20c is applied to its input G (Green). As a consequence, current flows from the input G, via current limiting resistor 17d and LED 13b to ground. The green LED 13b illuminates, and its emission causes the resistance of its associated phototransistor 16b to drop to a very low value. The current in the green LED 13b branch, from buffer 19b, via resistor 17b and phototransistor 16b, sharply rises to a value sufficient to maintain LED 13b illuminated.

To illuminate the device in yellow color, both pulses 20b, 20c are applied, either simultaneously or sequentially, to respective inputs R and G. As a consequence, currents flow from the input R, via current limiting resistor 17c and LED 13a, to ground and from the input G, via current limiting resistor 17d and LED 13b, to ground. Both red LED 13a and green LED 13b illuminate, and their emissions respectively cause the resistances of associated phototransistors 16a, 16b to drop to very low values. The currents in the red LED 13a and green LED 13b branches sharply rise to values sufficient to maintain both LEDs illuminated. The red and green light signals are blended to form a composite light signal of substantially yellow color. The hue of the composite light signal may be accurately adjusted by varying the values of current limiting resistors 17a, 17b.

Figure 4:
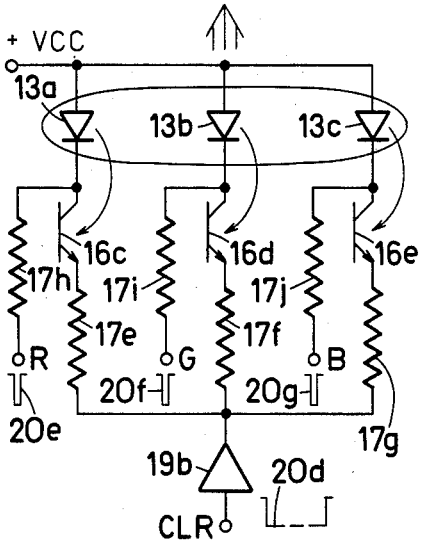
FIG. 4 is a schematic diagram of a three-primary color optical device.

Since the optical device shown in FIG. 4 is similar to the one shown in FIG. 3, it will be described only briefly. The LEDs 13a, 13b, and 13c are reversed with respect to like LEDs in FIG. 3, and a positive voltage +VCC (typically +5 V) is applied to their interconnected anodes. Logic levels of the control pulses are also reversed. The device may be extinguished by applying a high logic level to its Clear input CLR; a low logic level therein will maintain its instant condition. To illuminate the device in blue color, a negative going pulse 20g is applied to its input B (Blue). As a consequence, current flows from the source +VCC, via LED 13c and current limiting resistor 17j to input terminal B. The blue LED 13c illuminates, and its emission causes the resistance of its associated phototransistor 16e to drop to a very low value. The current in the blue LED 13c branch sharply rises to a value sufficient to maintain LED 13c illuminated, being limited only by the value of current limiting resistor 17g.

To illuminate the device in purple color, both pulses 20e, 20g are applied, either simultaneously or sequentially, to respective inputs R and B. As a consequence, currents flow from the source +VCC, via LED 13a and current limiting resistor 17h, to input terminal R and from the source +VCC, via LED 13c and current limiting resistor 17j, to input terminal B. Both red LED 13a and blue LED 13c illuminate, and their emissions respectively cause the resistances of associated phototransistors 16c, 16e to drop to very low values. The currents in the red LED 13a and blue LED 13c branches sharply rise to values sufficient to maintain both LEDs 13a and 13c illuminated. The red and blue light signals are blended to form a composite light signal of substantially purple color.

To illuminate the device in blue-green color, both pulses 20f, 20g are applied, either simultaneously or sequentially, to respective inputs G and B. As a consequence, currents flow from the source +VCC, via LED 13b and current limiting resistor 17i, to input terminal G and from the source +VCC, via LED 13c and current limiting resistor 17j, to input terminal B. Both green LED 13b and blue LED 13c illuminate, and their emissions respectively cause the resistances of associated phototransistors 16d, 16e to drop to very low values. The currents in the green LED 13b and blue LED 13c branches sharply rise to values sufficient to maintain both LEDs 13b and 13c illuminated. The green and blue light signals are blended to form a composite light signal of substantially blue-green color.

To illuminate the device in white color, all three pulses 20e, 20f, and 20g are applied, either simultaneously or sequentially, to respective inputs R, G, and B. As a consequence, currents flow from the voltage supply +VCC, via LED 13a and current limiting resistor 17h, to terminal R, from the voltage supply VCC, via LED 13b and current limiting resistor 17i, to terminal G, and from the voltage supply +VCC, via LED 13c and current limiting resistor 17j, to terminal B. The red LED 13a, green LED 13b, and blue LED 13c illuminate, and their emissions respectively cause the resistances of associated phototransistors 16c, 16d, and 16e to drop to very low values. The currents in the red LED 13a, green LED 13b, and blue LED 13c branches sharply rise to values sufficient to maintain all three LEDs 13a, 13b, and 13c illuminated. The red, green, and blue light signals are blended to form a composite light signal of substantially white color. If desired, the exact color of light produced by blending the emissions of the primary color lights may be determined by examining the values of x and y coordinates in a well known ICI chromaticity diagram (not shown).

Figure 5:
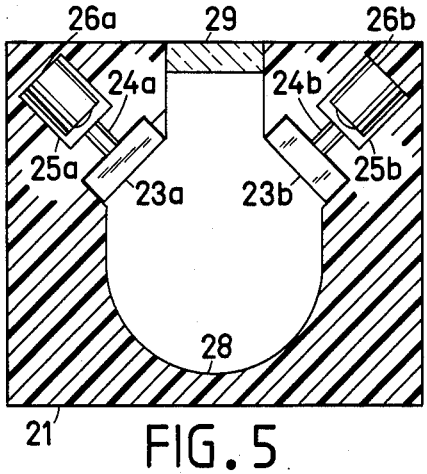
FIG. 5 is a cross-sectional view revealing internal structure of a two-primary color optical device.

An important consideration has been given to physical arrangement of the light sources and sensors in the optical device of the invention, to simultaneously provide the blending of primary colors and respective optical feedbacks in the pairs. Referring additionally to FIG. 5, which should be considered together with FIG. 3, the optical device is comprised of a housing 21 having two angularly extending tubular cavities 25a, 25b formed therein for accommodating respective phototransistors 26a, 26b. The dimensions of the housing should be considered as merely illustrative and may be modified, for example, to an elongated shape. Each phototransistor 26a, 26b is adhesively bonded or otherwise secured to the end wall of the cavity and axially extends therefrom. A red rectangular solid state lamp 23a, capable of emitting light in several directions, is secured in a recess adjacent cavity 25a and communicates with the light sensitive surface of phototransistor 26a through a small aperture 24a. The lamp 23a may be either frictionally retained in its position or secured therein by means of a suitable adhesive. In order to maintain phototransistor 26a in dark when the adjacent lamp 23a is extinguished, complete hermetic seal between lamp 23a and its recess may be achieved by disposing a sealant adhesive between lamp 23a and the surface of the recess adjacent the aperture. A green rectangular solid state lamp 23b is similarly disposed adjacent phototransistor 26b and communicates therewith through an aperture 24b. When both lamps 23a, 23b are extinguished, both phototransistors 26a, 26b are in dark and exhibit very high resistances. When the red lamp 23a is illuminated, light emitted from its surface adjacent phototransistor 26a falls directly, through aperture 24a, on the lens of phototransistor 26a, thereby causing it to exhibit very low resistance. The other surface of lamp 23a emits light which falls on a curved surface of reflector 28 and is directed through a transparent cover 29 out of the housing. When both lamps 23a, 23b are illuminated, both phototransistors 26a, 26b exhibit very low resistances. The light signals emitted by the outward surfaces of respective lamps 23a, 23b are blended, by being reflected on curved surface 28, to form a composite light of substantially yellow color which emerges through cover 29.

Figure 6:
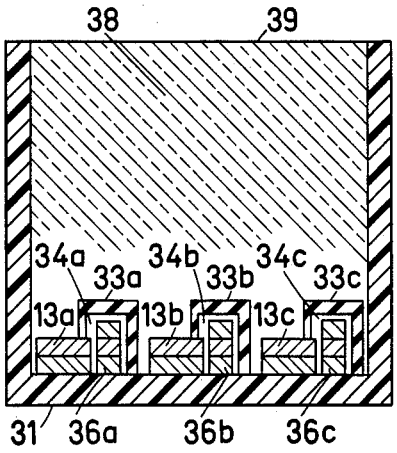
FIG. 6 is a cross-sectional view of a multicolor optical device in the form of an integrated circuit.

The optical device illustrated n FIG. 6 includes three pairs of associated closely adjacent LEDs and phototransistors 13a and 36a, 13b and 36b, 13c and 36c accommodated in a housing 31 and electrically coupled as in FIG. 4. The LEDs 13a, 13b, and 13c are upon activation capable of emitting light signals of respectively different primary colors from their top substantially flat surfaces of a predetermined uniform width. Three opaque insulating walls 33a, 33b, and 33c respectively define three chambers 34a, 34b, and 34c. In each chamber 34, phototransistor 36 is completely surrounded by opaque walls 33, but its associated LED 13 is only partially disposed therein. The LED 13 is partially overlayed by opaque wall 33 such that its first light emitting portion is located within chamber 34, and its remaining second light emitting portion projects beyond chamber 34. Vertically extending portion of opaque wall 33, having a bottom of a thickness less than the width of the top light emitting surface of LED 13, abuts LED 13 and provides a hermetic seal therebetween so as to secure chamber 34 from the presence of ambient light. The active area of phototransistor 36 is oriented to intercept light signals emitted from the first light emitting portion of LED 13 within chamber 34 to exert a toggle effect by varying the resistance of phototransistor 36 in a sense tending to maintain LED 13 either in its illuminated condition or in its extinguished condition. The light signals emitted from the second light emitting portions of LEDs 13a, 13b, and 13c that extend beyond chambers 34a, 34b, and 34c are blended by passing through transparent light scattering material 38 and emerge at top 39 of the device as a composite light signal. The color of the composite light signal may be varied in seven steps by selectively transferring the LEDs 13a, 13b, and 13c from one to other of their conditions. It is further contemplated that the simultaneous blending of the primary color lights and providing of respective optical feedback in the pairs of LEDs and phototransistors may be alternatively achieved by modifying the shapes of the LEDs.

It would be obvious that persons having ordinary skill in the art may resort to numerous modifications in the construction of the preferred embodiments shown herein, without departing from the spirit of the invention as defined in the appended claims.

CORRELATION TABLE

This is a correlation table of reference characters, their descriptions, and examples of commercially available parts.

| # | DESCRIPTION | EXAMPLE |
|---|---|---|
| 11 | light source | |
| 12 | light sensor | |
| 13a | red light emitting diode | |
| 13b | green light emitting diode | |
| 13c | blue light emitting diode | |
| 14 | light activated device | |
| 16 | phototransistor | |
| 17 | resistor | |
| 19 | buffer | 74LS244 |
| 20 | pulse | |
| 21 | housing | |
| 23a | Hewlett Packard red solid state lamp | HLMP-0300/0301 |
| 23b | Hewlett Packard green solid state lamp | HLMP-0503/0504 |
| 24 | aperture | |
| 25 | cavity for phototransistor | |
| 26 | Motorola phototransistor | MRD310 |
| 28 | curved reflecting surface | |
| 29 | transparent cover | |
| 31 | housing | |
| 33 | opaque wall | |
| 34 | chamber | |
| 36 | phototransistor | |
| 38 | light scattering material | |
| 39 | top surface | |

What I claim is:

1. A multicolor optical device comprising:

a housing including a substantially flat support;

a plurality of light sources for emitting light signals of respectively different colors disposed on said support, each said light source having a substantially flat top surface of a predetermined width for emitting light signals, each said light source being capable of an illuminated condition and an extinguished condition;

a plurality of opaque walls secured in said housing and respectively associated with said light sources, each said opaque wall having a bottom of a thickness less than the width of the top surface of its associated light source, for respectively abutting the top surfaces of said light source for dividing each said light source into a first light emitting portion and a second light emitting portion;

means for blending light signals emitted from said first light emitting portions of said light sources to obtain a composite light signal of a color in accordance with the conditions of respective light sources;

a plurality of light sensors respectively associated with said light sources in pairs;

in each said pair the light sensor being oriented to intercept light signals emitted from said second light emitting portion of its associated light source for establishing an optical feedback tending to stabilize each said light source in its condition to thereby maintain the color of said composite light signal.

2. A multicolor optical device comprising:

a housing including a substantially flat support;

a plurality of light emitting diodes for emitting light signals of respectively different colors disposed on said support, each said light emitting diode having a substantially flat top surface of a predetermined width for emitting light signals, each said light emitting diode being capable of an illuminated condition and an extinguished condition;

a plurality of opaque walls secured in said housing and respectively associated with said light emitting diodes, each said opaque wall having a bottom of a thickness less than the width of the top surface of its associated light emitting diode, for respectively abutting the top surfaces of said light emitting diodes for dividing each said light emitting diode into a first light emitting portion and a second light emitting portion;

means for blending light signals emitted from said first light emitting portions of said light emitting diodes to obtain a composite light signal of a color in accordance with the conditions of respective light emitting diodes;

a plurality of light sensors respectively associated with said light emitting diodes in pairs;

in each said pair the light sensor being oriented to intercept light signals emitted from said second light emitting portion of its associated light emitting diode for establishing an optical feedback tending to stabilize each said light emitting diode in its condition to thereby maintain the color of said composite light signal.

* * * * *